United States Patent [19]

Stahl

[11] 4,224,954

[45] Sep. 30, 1980

[54] DEVICE FOR USE IN BLEACHING OR COLORING HAIR IN DISCRETE PORTIONS FOR ARTISTIC EFFECT

[76] Inventor: Michael L. Stahl, 7700 SW. 135th Ave., Miami, Fla. 33183

[21] Appl. No.: 921,981

[22] Filed: Jul. 5, 1978

[51] Int. Cl.[2] ..... A45D 7/00

[52] U.S. Cl. ..... 132/7

[58] Field of Search ..... 132/7, 9, 43 A, 43 R, 132/39, 36

[56] References Cited

U.S. PATENT DOCUMENTS

| | | | |
|---|---|---|---|
| 1,612,911 | 1/1927 | Durnerin | 132/43 A |
| 1,994,099 | 3/1935 | Fulton | 132/43 A |
| 2,092,578 | 9/1937 | Interrante | 132/43 A |
| 2,601,428 | 6/1952 | Bonneau | 132/43 R |
| 4,022,225 | 5/1977 | Kauffman | 132/43 R |

*Primary Examiner*—G. E. McNeill

*Attorney, Agent, or Firm*—Meredith P. Sparks

[57] ABSTRACT

A device for use in bleaching or coloring hair in discrete portions comprised of a thin planar base member with a hand grip portion at first end, a generally U-shaped top member including a transverse span portion atop the base member, adjacent the hand grip portion, and a pair of generally parallel arms or thin planar material extending from the span portion along the base member, adjacent the respective side edges thereof, to points adjacent a second end of the base member. A moisture impervious flexible sheet of a suitable material, such as aluminum foil, is disposed between the base and U-shaped top members. A lock of hair is disposed over at least a portion of the central area of the foil, and a hair coloring or bleaching fluid is applied thereto. A pair of oppositely outwardly extending wing portions of the foil is folded over the lock of hair, after which the device is slidably removed from the foil, which remains in wrapped engagement about the lock of hair. Preferably, the foil has a fold at the base to add strength to end part and to catch and hold any excess fluid which might run off the hair. The wings are then folded to form a packet which separates the hair to be altered from the remaining hair on the head.

10 Claims, 4 Drawing Figures

DEVICE FOR USE IN BLEACHING OR COLORING HAIR IN DISCRETE PORTIONS FOR ARTISTIC EFFECT

BACKGROUND OF THE PRESENT INVENTION

The present invention pertains to a device for use in bleaching or coloring discrete portions of the hair, and more particularly for use in applying a suitable hair dye or bleach to selected hair areas or locks in hair coloring operations known in the trade as frosting, streaking, tipping, etc., as opposed to bleaching or dying an entire head of hair.

A variety of devices are currently in use to accomplish hair frosting, streaking and tipping operations; for example, one of the most widely used device consists of a relatively snug fitting cap which substantially covers the entire hair area of the head. A plurality of holes are provided through the cap and the hair dresser uses a hook member to engage selected locks of hair through the holes to pull the entire locks outwardly. The desired coloring fluid is then applied to all of the outwardly extended locks of hair. The pulling procedure generally causes a substantial amount of discomfort to the customer and frequently results in outright pain.

The present invention provides a relatively thin planar base member with a top U-shaped member hinged thereto. A relatively wide sheet of a moisture impervious flexible sheet of material such as aluminum foil is disposed between the base and U-shaped planar member, a lock of hair is disposed over the central portion of the foil and the appropriate bleaching or coloring fluid is applied to the hair. A pair of oppositely outwardly extending wing portions of the foil are then folded over portions of the U-shaped member and the lock of hair to which the bleaching or coloring fluid has been applied. The device is then slid free of the foil containing the lock of hair wrapping. The foil may be further folded, if desired.

Therefore, one of the principal objects of the present invention is to provide a planar base member with a hand grip portion at a first end thereof and a U-shaped member pivotally attached to a top side of the base member, adjacent the hand grip portion, and extending to points adjacent to a second end of the base member.

Another object of the instant invention is to provide a sheet of suitable moisture impervious flexible material, such as aluminum foil, for insertion between the base and U-shaped members, the foil sheet being preferably of a length so as to extend from the hinge connection at least to the second end and of a width so as to cover the width of the top surface of the base member with oppositely outwardly extending wing portions sized to permit their being folded over a lock of hair positioned along the central portion thereof into an overlapping relation.

DETAILED DESCRIPTION OF A PREFERRED EMODIMENT

Figure 1:
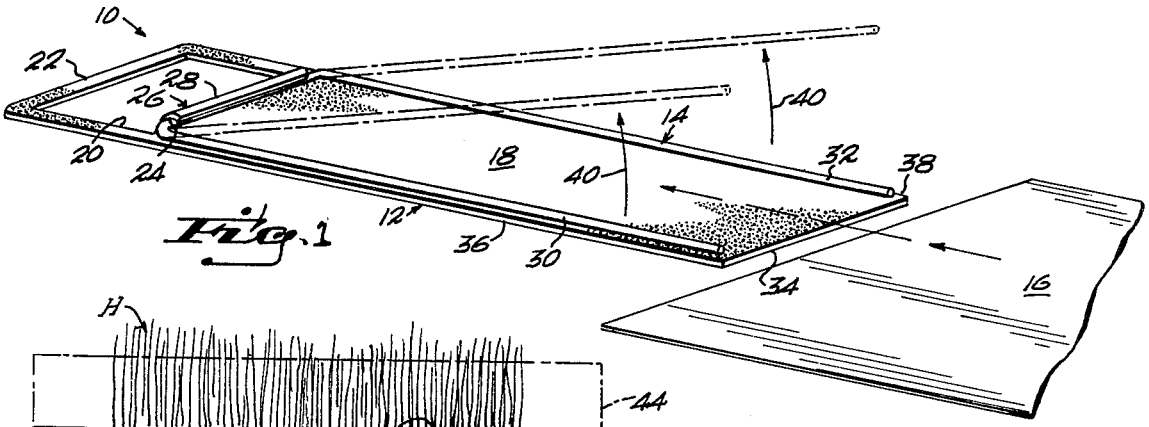
FIG. 1 is a perspective view of the base and U-shaped members, in assembly, and a fragmentary portion of a sheet of a suitable moisture impervious flexible material such as aluminum foil, in a position for insertion between the base and U-shaped members.

With reference to the drawings, in which like reference characters designate like or corresponding parts throughout the various views, and with particular reference to FIG. 1, the device for use in bleaching or coloring hair, of the present invention, is designated generally at 10 and includes a base member 12 and a top U-shaped member 14. A sheet of a suitable moisture impervious material such as aluminum foil is fragmentarily illustrated at 16.

The base member 12 includes a main elongated length 18 and a cut-out 20, defining a handle 22 at a first end portion. The handle 22 may be of any appropriate configuration. U-shaped top member 14 includes transverse span portion 24, hinged at 26 to the base member 12 along an inner edge of the cut-out 20. Hinge 26, in one form, as illustrated, may be a partial roll 28 to permit the span portion 24 to be snapped thereinto for outward, inward pivotal movement. Because of the corrosive nature of the bleaching or coloring fluid to which the base member and hinged member are exposed, the base member 12 is preferably formed of a suitable plastic material and the U-shaped member 14 may be formed of a suitable plastic material or a plastic coated wire. A pair of generally parallel legs 30 and 32 extend from span portion 24 to positions adjacent a second end 34 of base member 12. Legs 30, 32 normally lie atop base member 12 adjacent the respective longitudinal edges 36, 38 thereof. As indicated by arrows 40, 40, the U-Shaped top member 14 may be pivoted upwardly sufficiently for the insertion of foil sheet 16 between it and base member 12.

Figure 2:
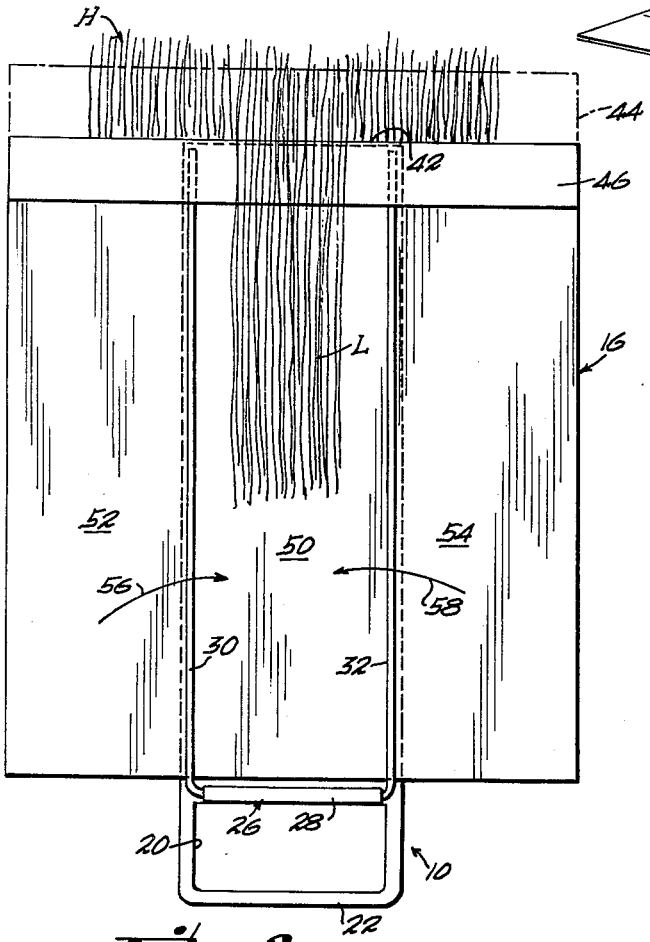
FIG. 2 is a top plan view of the device of the present invention with the foil sheet disposed in place in an unfolded condition and with a lock of hair positioned thereon.
Figure 3:
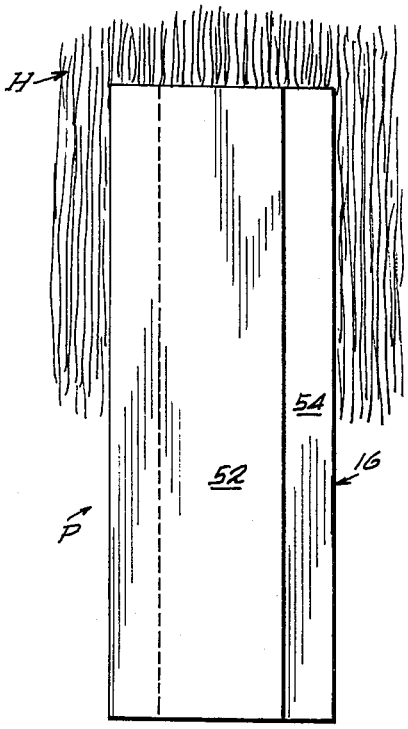
FIG. 3 is a top plan view of the foil sheet in a folded covering relation to the lock of hair.
Figure 4:
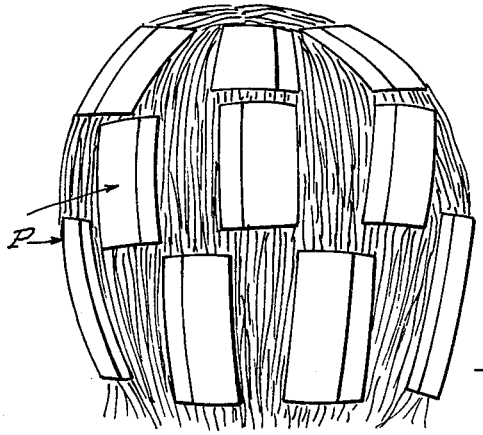
FIG. 4 is a view illustrating the back portion of a head with a plurality of hair packets in place as defined by the use of the device of the present invention.

After the insertion of the foil sheet 16, the assembly is positioned against the hair H, as in FIG. 2 on a head and a lock of hair L is combed or drawn over the leading end 42 thereof. The foil sheet 16 may be somewhat longer than the lengths of legs 30, 32 as at 44, to permit its being folded inwardly over the end portion of legs 30, 32 as at 46, to add strength to leading end 42, and when folded to catch and hold any excess fluid which might run off the hair. The lock of hair L overlies the central portion 50 of foil sheet 16 and the oppositely extending wing portions 52, 54 thereof are then folded over lock L as indicated by arrows, 56, 58. The device 10 is then simply slid from engagement with the resulting hair packet P, FIGS. 3 and 4.

If desired, the packet P may be folded over upon itself or left at full length, as determined by the operation being performed. For example, in a "tipping" operation where only the tip of the hair has the color altered, the lock of hair L may be much shorter than illustrated, and in a "streaking" operation, the lock of hair L may be much longer than illustrated. It should also be noted that the device 10 may be fabricated in various sizes with widely varying lengths and widths. For example, the optimum size and shape of the device for use at the front of the head varies from that to be used over the ears, or at the back of the head near the hair line. The beautician may have on hand several devices, each one a preferred size or shape for the total operation. The overall measurements of three sizes found to be useful in the invention are (a) 3"×8", (b) 2½"×7½", and (c) 1¾"×6½".

The hair can be separated in discrete portions to form a pattern or design for versatile artistic effect. At times the bleaching or coloring operation is applied only to hair at certain parts of the head, such as the front or the sides, as desired by the customer.

I claim:

1. A device for use in bleaching and coloring hair comprising a generally planar base member of a predetermined length and width, including first and second, end portions and opposed longitudinal side edge portions; a generally U-shaped top member including a transverse portion, hinged along a top surface of said first end portion and a pair of elongated leg portions normally disposed respectively along top surfaces of said longitudinal side edge portions, and a moisture impervious flexible sheet for insertion between said base member and U-shaped member, said sheet including a central portion sized to substantially cover a top surface of said planar base member from said hinge to said second end, when so inserted, and including opposed outwardly extending wing portions of sufficient widths to cover said central portion in an overlapping relation when said wing portions are folded oppositely inwardly over said legs, and said sheet sized to include an end portion extending outwardly from said end portion of said planar base, which end portion when folded over in a lapped engagement with said overlapped wing portions define a packet for containing said lock of hair and any fluid applied to said lock of hair, characterized by the feature that, in operation, the device is slid free of said packet containing said lock of hair and fluid by means of said hand grip portion, so that the device can then be used again for another lock of hair while said packet remains on the head, and the operation continued until a sufficient number of locks are colored or bleached for artistic effect.

2. The device as defined in claim 1 wherein said flexible sheet is formed of aluminum foil.

3. The device as defined in claim 1 including a hand grip portion extending longitudinally outwardly from said planar base first end.

4. The device as defined in claim 1 wherein said planar base is formed of a suitable plastic material.

5. The device as defined in claim 1 wherein said U-shaped top member is formed of a suitable plastic material.

6. The device as defined in claim 1 wherein said U-shaped top member is formed of a plastic coated wire.

7. The device as defined in claim 1 wherein said flexible sheet includes a forwardly extended portion for a folded lapped engagement over forward end portions of said legs.

8. The device as defined in claim 1 in which the outside dimensions are about 2–3" in width and about 6–8" in length.

9. A method of bleaching and coloring hair comprising:

(A) providing a generally planar base member of a predetermined length and width and a generally U-shaped top member including a transverse portion hinged along a top surface of a first end portion of said base member, and a pair of elongated leg portions normally disposed respectively along top surfaces of longitudinal side edge portions of said base, (B) inserting a flexible sheet of an appropriate moisture impervious material between said base and U-shaped top member, said sheet including a central portion sized to substantially cover a top surface of said planar base member from said hinge to a second end thereof and including outwardly extending wing portions of sufficient widths to cover said central portion in an overlapping relation when said wing portions are folded oppositely inwardly over said legs, (C) separating a discrete lock of hair to be colored from the balance of the hair on a person's head, and disposing said lock over said central portion inwardly from said second end, (D) applying an appropriate coloring fluid to said lock of hair on said central portion, (E) folding said wing portions oppositely inwardly from said extended portions, over said lock to define a packet, (F) sliding said U-shaped top member, along with said planar base member, from engagement with said packet.

10. The method as defined in claim 9 including the provision of a forwardly extended portion from a forward end of said flexible sheet and folding said forward extension in a lapped engagement over a forward end portion of said packet.

* * * * *